United States Patent [19]

Breslow et al.

[11] 4,109,916

[45] Aug. 29, 1978

[54] PINBALL GAME WITH SIMULTANEOUS PROJECTORS

[75] Inventors: Jeffrey D. Breslow, Highland Park; Eugene Jaworski, Park Ridge, both of Ill.

[73] Assignee: Marvin Glass & Associates, Chicago, Ill.

[21] Appl. No.: 687,402

[22] Filed: May 17, 1976

[51] Int. Cl.[2] ..... A63D 3/02; A63D 13/00

[52] U.S. Cl. ..... 273/121 A; 273/129 HA; 273/129 D; 340/323 B

[58] Field of Search ..... 200/61.11; 273/118 A, 273/121 A, 124 A, 129 R, 129 GA

[56] References Cited

U.S. PATENT DOCUMENTS

| | | | |
|---|---|---|---|
| 2,088,258 | 7/1937 | Brietenstein | 273/122 A |
| 2,093,163 | 9/1937 | Breitenstein | 273/121 A |
| 2,551,698 | 5/1951 | Pearl et al. | 273/121 A |
| 2,642,290 | 6/1953 | Moloney et al. | 273/118 A |
| 2,864,620 | 12/1958 | Hooker et al. | 273/124 A |
| 3,180,646 | 4/1965 | Zale et al. | 200/61.11 |
| 3,298,691 | 1/1967 | Berninger et al. | 273/129 R |
| 3,404,888 | 10/1968 | Lally et al. | 273/121 A |
| 3,582,074 | 6/1971 | Menotti | 273/121 A |
| 3,675,927 | 7/1972 | Gottlieb et al. | 273/119 A |

FOREIGN PATENT DOCUMENTS

| | | | |
|---|---|---|---|
| 493,343 | 5/1950 | Belgium | 273/121 A |
| 1,373,806 | 10/1964 | France | 273/121 A |
| 1,154,600 | 1/1957 | France | 273/121 A |
| 26,642 | 1/1956 | Fed. Rep. of Germany | 273/121 A |

OTHER PUBLICATIONS

Out of Sight Pinball Game Literature from Gottlieb & Co., received Mar. 21, 1977, and Affidavit of Lawrence E. Anderson.

*Primary Examiner*—Richard C. Pinkham
*Assistant Examiner*—Lawrence E. Anderson
*Attorney, Agent, or Firm*—Mason, Kolehmainen, Rathburn & Wyss

[57] ABSTRACT

An electro-mechanical pinball game which includes an inclined playing board sloped downwardly toward the player which provides a surface for rollingly supporting a suitable ball. A plurality of rocking wafer-type ball repelling bumpers are mounted on the playing board and simultaneously actuated when a ball rolling thereover engages any one of the bumpers. A plurality of ball repelling, slingshot type cushions are similarly mounted on the playing board and simultaneously actuated when a ball engages any of the individual cushions. A plurality of flippers are pivotally mounted on the game board and interconnected by a single drive apparatus which actuates all of the flippers when either one of two flipper control buttons are manually actuated by a player of the game. A scoring mechanism is provided and includes counting registers which are incremented by a single device which also produces an audible signal indicating that a particular score has been achieved.

2 Claims, 6 Drawing Figures

Fig 1
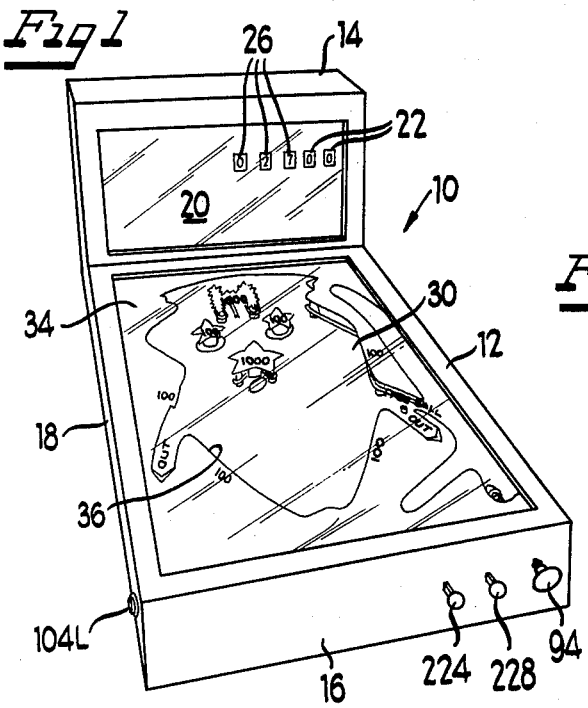
Fig 3
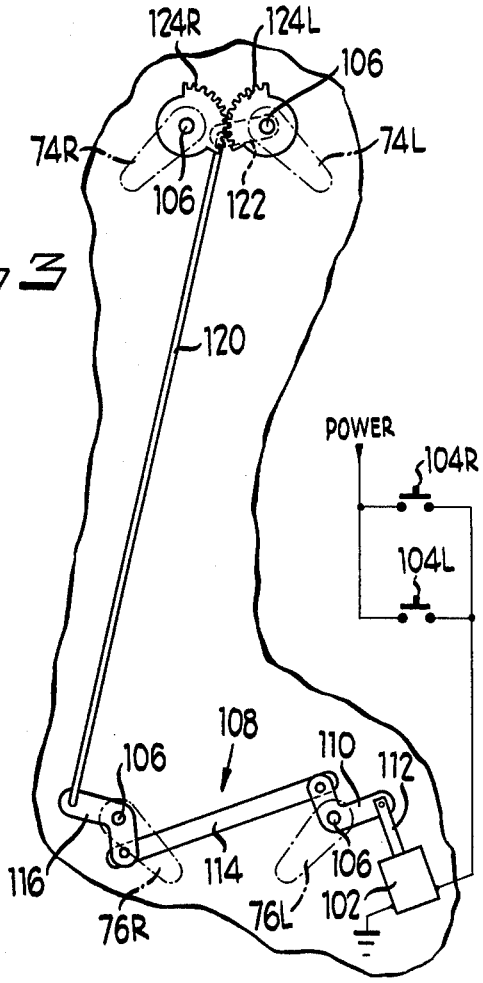
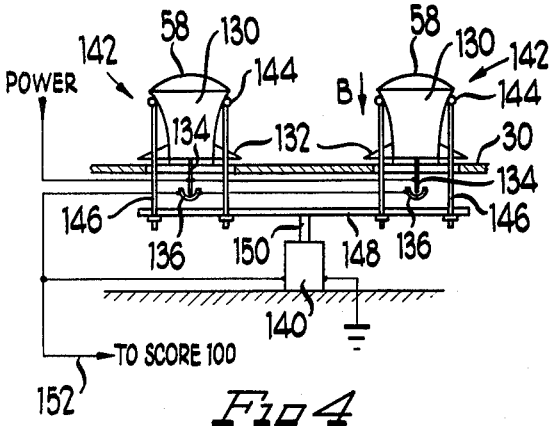
Fig 4
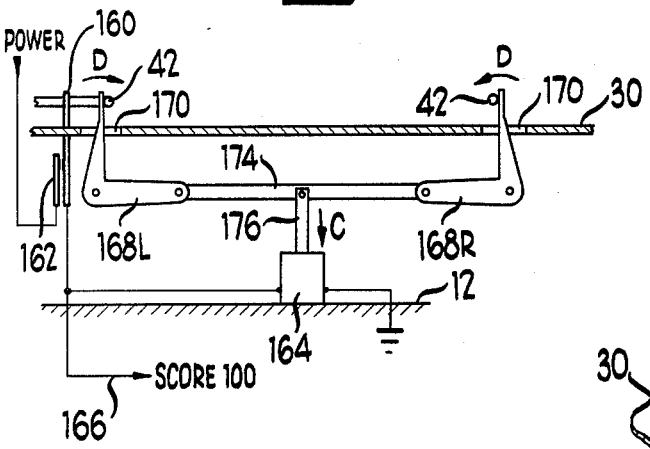
Fig 5
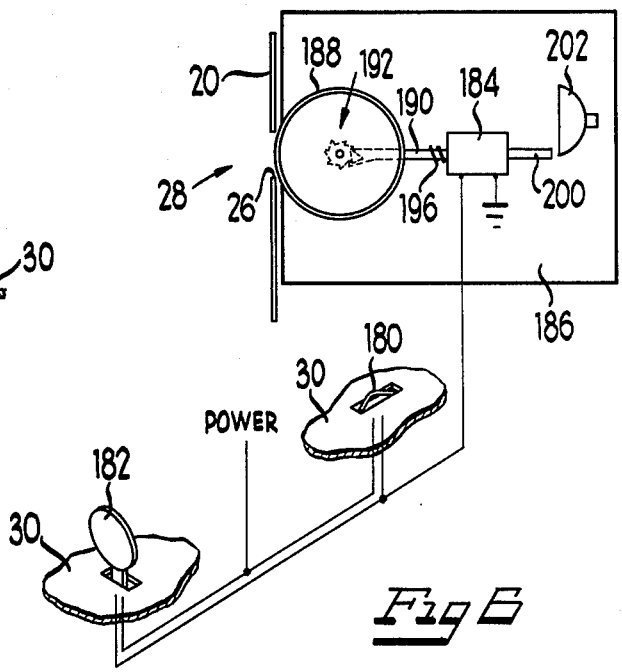
Fig 6

10
14
12
50
54
180
52
80
100
44
40
42
4
58
90
70
68
74L
74R
A
78
64
60
62
182
66
84
88
30
5
160
76L
76R
82
104L
104R
222
32
96
92
230
E
221
220
225
83
224
228
94

PINBALL GAME WITH SIMULTANEOUS PROJECTORS

BACKGROUND OF THE INVENTION

1. Field of the Invention

The present invention relates to game apparatus and more particularly to a pinball type game.

2. Brief Description of the Prior Art

Many pinball games have been produced and have provided enjoyment and entertainment for the players while developing their reflexes and skill of playing the games. Conventional pinball machines are usually coin-operated type devices for use by many participants in an arcade which incorporates many of these types of machines. In the past, most of these devices have been expensive to produce in order to provide the various features and elements which make the games exciting to play.

SUMMARY OF THE INVENTION

It is an object of the present invention to provide a novel type pinball machine which is less expensive to manufacture while providing the same excitement and enjoyment to the players of the game.

Another object of the invention is to provide a game which, by virtue of its smaller number of parts, can be more efficiently and economically produced for mass consumption by the public.

In accordance with the above and other objects, the present invention provides a pinball game which includes a plurality of ball rebounding bumpers which are simultaneously actuated by a single drive means. The game also includes a plurality of slingshot type cushions which keep the ball in play over a substantially longer period of time and which are more efficiently actuated by a single mechanism. A novel scoring device simultaneously actuates a plurality of counters and provides an audible signal to the players of the game when a score is achieved. A plurality of ball rebounding flippers are provided to change the direction of travel of the ball and means are provided to actuate all of the flippers upon depressing either one of a pair of flipper buttons mounted on the exterior of the device.

Other objects, features and advantages of the invention will be apparent from the following detailed description taken in connection with the accompanying drawings.

BRIEF DESCRIPTION OF THE DRAWINGS

FIG. 1 is a perspective view of a pinball game apparatus made in accordance with the concepts of the present invention;

FIG. 3 is a partially fragmented, bottom plan view of the flipper drive means of the present invention;

FIG. 4 is a partially fragmented, vertical section of the pinball game apparatus taken generally along line 4—4 of FIG. 2;

FIG. 5 is another partially fragmented vertical section of the pinball game apparatus taken generally along line 5—5 of FIG. 2; and FIG. 6 is a somewhat schematic, perspective view of the scoring device of the present invention.

DESCRIPTION OF THE PREFERRED EMBODIMENT

Figure 2:
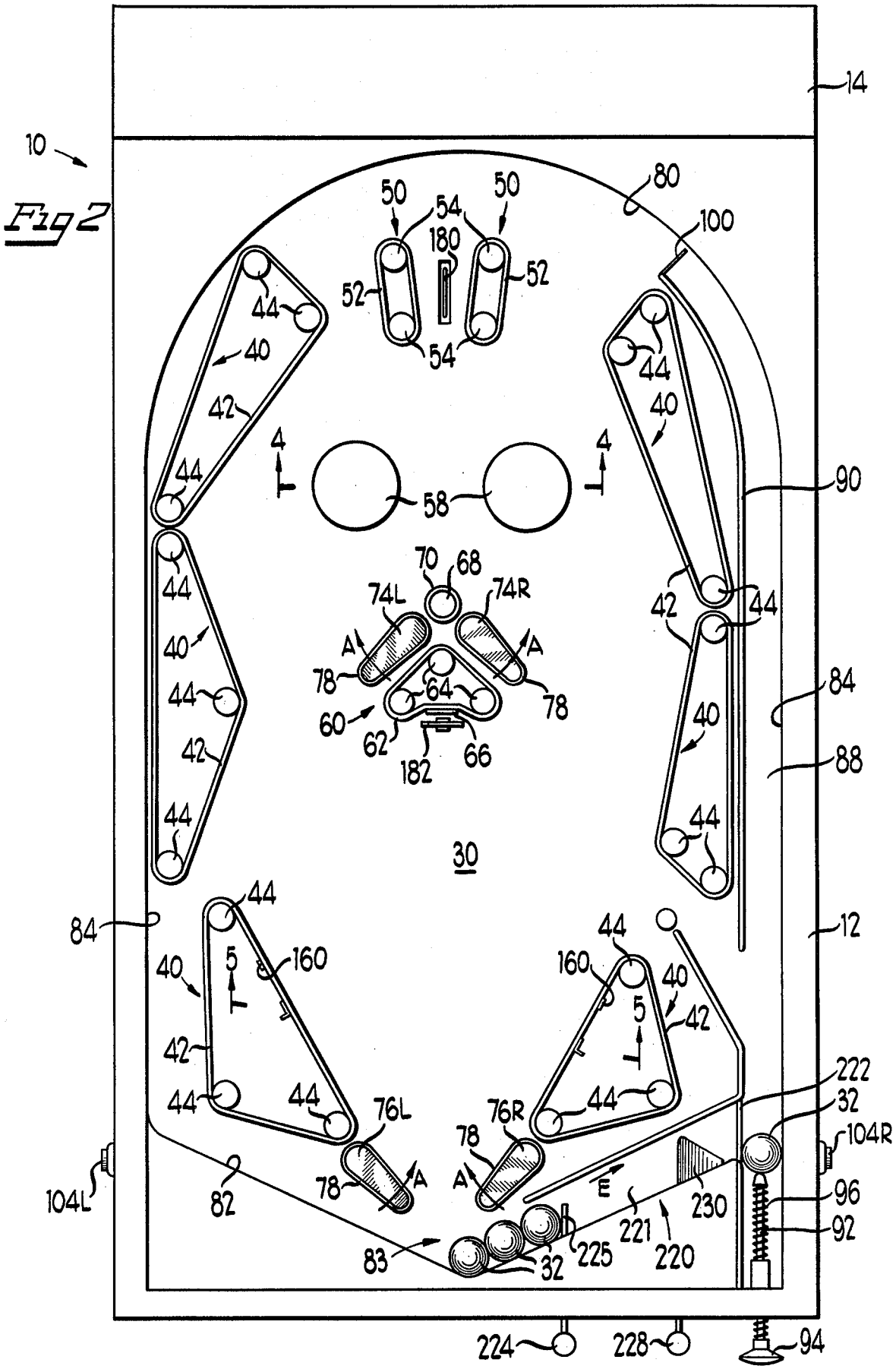
FIG. 2 is a top plan view, on an enlarged scale, of the playing board of the pinball game of FIG. 1.

A pinball game apparatus, generally designated 10, is shown in FIG. 1 to include a generally rectangular horizontal housing portion 12 and a vertical display housing portion 14. The housing 12 includes a front control panel 16 including a plurality of controls accessible to the player of the game, and a pair of side walls 18 mounting other controls. The display housing 14 includes a front display panel 20 which may be provided with art work or other information relative to the play of the game. The display panel 20 includes two scoring numerals 22 which are printed on the display panel 20 and a plurality of windows 26 through which a changeable scoring device, generally designated 28 (FIG. 6), is visible.

The housing portion 12 mounts a playing board 30 which is inclined downwardly toward the front panel 16 toward a player of the game. A plurality of balls 32 are positioned on the playing board 30 for use during the play of the game. A transparent sheet, generally designated 34, such as glass, plexiglass or the like, is mounted above the playing board 30 so that the board is viewable to the players of the game and yet not manually accessible to the players. Preferably, the panel 34 includes various indicia or other art work 36 applied directly to the underside of the panel 34 to indicate various scores and to hide or disguise features on the playing board as will be described in greater detail hereinafter.

FIG. 2 generally shows a top plan view of the pinball game 10 with the sheet 34 removed to show all of the elements on the game board 30. The elements on the game board include six reboundable cushions, generally designated 40, about the periphery of the board 30 of various triangular configurations. Each of the cushions 40 includes a continuous flexible band 42 mounted above the playing surface 30 by three non-aligned generally perpendicular studs or posts 44. Each of the studs 44 includes a circular groove for positioning the band 42 at an elevation above the playing surface 30 at a distance substantially equal to one-half the diameter of the balls 32. As the balls 32 roll down the inclined playing surface 30 and engage the flexible bumper bands 42, their direction of travel down the board is changed.

A pair of similar flexible bumpers, generally designated 50, are mounted at the top of the game board 30, on either side of the longitudinal centerline of the board. Each bumper 50 includes a similar flexible band 52 supported by two posts 54. A pair of rocking wafer-type bumpers 58, to be discussed in detail hereinafter, are symmetrically mounted on the playing board 30 below the cushions 40. A smaller triangular bumper, generally designated 60, is mounted at approximately the midpoint of the game board 30 and includes a band 62 stretched around three posts 64. An additional, substantially flat upstanding pad 66 is provided to slightly deform the shape of the bottommost portion of the band 62 as shown in FIG. 2. A stationary upstanding post 68 carrying a circular resilient ring 70 is mounted directly above the triangular cushion 60.

Four pivotally mounted ball engaging flippers 74R, 74L, 76R and 76L are positioned as opposing pairs at the midpoint and lower end of the game surface 30. Each flipper includes a resilient surface 78 for contacting the balls 32. The perimeter of the playing board 30 is defined by a generally semicircular border 80 at the uppermost end thereof and a generally V-shaped border 82 at the lowermost end to direct the balls to a ball exit opening 83 as shown in FIG. 2. A pair of flat, parallel walls 84 define the two sides of the playing board 30. A ball feed channel 88 is provided between the right side wall 84 and a substantially thin upstanding rib 90 mounted to the top of the playing surface 30. A spring biased plunger 92 is mounted at the lower end of the feed channel 88 for propelling a ball 32 onto the playing surface 30. The plunger is operated by manually pulling a knob 94 rearwardly against the biasing force of a spring 96, and released, which propels a ball 32 up the feed channel 88 and onto the top of the playing surface 30. A spring biased gate 100, such as a leaf spring or the like, is provided at the top end of the channel 88 to define a ball entrance opening and to prevent a ball from inadvertently traveling back down the channel 88.

Referring to FIG. 3, all of the flippers 74R, 74L, 76R, and 76L are operated by a single flipper solenoid 102. The solenoid 102 is actuated by either one of two manually operated flipper buttons or actuators 104L and 104R mounted on the respective side walls 18 of the housing 12. The schematic electrical diagram of FIG. 3 illustrates the parallel manner in which the push button switches 104L or 104R actuate the solenoid 102. Each of the flippers is pivotally mounted on the playing surface by a generally perpendicular shaft 106 which extends below the surface for connection to a mechanical linkage, generally designated 108. Referring to FIG. 3, an L-shaped crank 110 is secured to the shaft 106 of flipper 76L and pivotally connected to the solenoid shaft 112. The opposite end of the crank 110 is pivotally connected to a generally transverse connecting rod 114 which is pivotally connected to a second L-shaped crank 116 secured to the shaft 106 of the flipper 76R. The opposite end of the crank 116 is connected by an elongated, generally longitudinal rod 120 to a simple crank arm 122 secured to the shaft 106 of the flipper 74L. A pair of meshing arcuate gears 124L and 124R are secured to the shafts of the respective flippers 74L and 74R to rotate the flippers in opposite directions. Therefore, when either of the buttons 104R or 104L is depressed to actuate the solenoid 102, all four of the flippers will be pivoted as shown by the arrows A in FIG. 2.

The bumpers 58 are conventional rocking wafer-type thumper bumpers which are interconnected to one another in a novel manner. Particularly, each bumper includes a stationary flared post portion 130 secured to the playing board surface 30. A rockable disc or wafer 132 is loosely mounted about the base of the post 130 so that it will pivot when engaged by a ball 32 rolling on the surface. A depending contact 134 is connected to each wafer and energized by a power supply to engage a second contact 136 when the wafer is tilted by contact with a ball. The contact 136 connects the power supply to a bumper drive means or solenoid 140 which actuates a ball propulsion means, generally designated 142 on each bumper. The ball propulsion means 142 includes a circular ring or disc 144 which is normally in a retracted position generally near the top of the post 130. Each ring 144 is connected by a pair of vertical shafts 146 to a generally horizontal connecting rod 148 secured to the end of the solenoid armature 150. Therefore, as either of the bumper wafers 132 is engaged by a ball 32, the contacts 134 and 136 will be made, thus energizing the solenoid 140 which moves the rings 144 downwardly in the direction of arrow B in FIG. 4. One of the rings 144 will engage the ball which has struck its associated wafer 132 thus pinching or propelling the ball away from the bumper, usually in an opposite direction from its approach. Therefore, only a single solenoid is required to operate the two bumpers as shown and, as described with respect to the flippers, could operate other pairs or individual bumpers without departing from the spirit and scope of the present invention. As will be described in detail hereinafter, when the contacts 134 and 136 are made on either of the bumpers 58, power is supplied through a line 152 to a scoring mechanism to score 100 points for the player of the game.

Referring to FIG. 5, the pair of resilient cushions 40 on either side of the lower end of the playing board 30 are provided with means to rapidly and sharply direct the ball away from the cushions to provide a slingshot action. More particularly, each of these cushions 40 includes an elongated contact 160 (schematically represented) which extends through an aperture in the playing surface to contact the flexible band 42 on the interior of the defined triangle. The contact extends downwardly adjacent a second contact 162 connected to the power supply. When a ball engages the inwardly directed band portion 42 of either of these two cushions, the contacts 160 and 162 are made which provide power to a slingshot actuation solenoid 164 or cushion drive means mounted within the housing 12. Similarly, as before, power is supplied to a line 166 to the scoring device to add 100 points to the player's score. A pair of crank arms 168R and 168L are pivotally mounted below the playing board 30 having a generally vertical portion thereof extending upwardly through an aperture 170 to engage the inner surface of the respective band portions 42. The opposite end of each of the cranks 168L and 168R are pivotally connected to a generally horizontal shaft 174 secured to the armature 176 of the solenoid 164. Therefore, when the contacts 160 and 162 are made, the solenoid 164 is energized moving the armature in the direction of arrow C as shown in FIG. 5, which drives both of the cranks 168L and 168R in a pivotal direction as shown by arrow D in FIG. 5. In this manner, the same solenoid is energized by contacting either of the two lowermost cushion portions 42 and a 100 point score is achieved.

The operation of the scoring mechanism 28 can be seen as shown schematically in FIG. 6. A pair of contacts (not shown) are mounted generally on the centerline of the playing board below a trip wire 180 mounted between the targets 50 and a circular switch pad 182 mounted in front of the cushion 60. When either of these contacts are made, by a ball rolling over the wire 180 or contacting the disc 182, power is supplied to a 1,000 digit or point scoring solenoid 184 shown mounted on a vertical plate 186. The vertical plate 186 is mounted behind the display panel 20 and carries a rotatably mounted scoring drum 188. The drum 188 includes the numbers from 0 to 9 printed on the outside periphery thereof and is positioned so that one of the numbers will appear through the central aperture 26 in the display 20. The solenoid 184 includes an armature 190 which increments the drum 188 through a claw and ratchet mechanism 192 each time the solenoid 184 is energized. Thus, each time the switch 180 or target 182 is engaged by a rolling ball 32, the drum will increment one numeral representing a score of 1,000 points. The solenoid armature 190 is biased by a spring 196 so that after the solenoid becomes de-energized, the armature moves the claw of the mechanism 192 over the next tooth. The solenoid armature 190 includes a rearwardly directed extension 200 on the rear side of the solenoid 184. A bell 202 or xylophone bar (not shown) is mounted in a stationary position on the plate 186 so that the rearward extension 200 of the armature 190 will contact and ring the bell 202 each time the solenoid is energized, to produce an audible signal indicating that a score has been achieved.

A duplicate scoring system, such as the one just described, is provided for the righthandmost aperture 26 to indicate a score of 100 points when a signal is provided on either of lines 152 or 166. Since the mechanism is substantially identical to that just described, it is not necessary to go into the details thereof. Finally, a third or 10,000 point drum is positioned behind the lefthandmost aperture 26. The 10,000 point drum and the 1,000 point drum are automatically incremented to the 1,000 point drum 188 and the 100 point drum, respectively, after they reach the numeral 9, in a conventional manner.

A "dead ball" feed system, generally designated 220, is shown at the bottom of the playing surface 30 in FIG. 2. The feed system includes a surface 221 which slopes downwardly in the direction of arrow E and terminates in a rib 222 adjacent the ball feed channel 88. A pivotally mounted stop lever 224, extending through the control panel 16, and terminating in a ball stop 225, extends above the surface 221 to prevent the ball 32 from rolling down the surface. At the end of a game, when a player is desirous of beginning a new game with a new set of balls, the stop lever 224 is depressed to let all of the balls roll down the surface 221 into engagement with the rib 222. When the stop lever 224 is depressed in this manner, a set of contacts (not shown) is made which resets the scoring drums, described above, to 0 in a conventional manner which need not be described herein. This dead ball feed system 220 thus provides an interlock which will prevent any one of the players from attempting to reuse a particular ball, since once the stop lever 224 is depressed, the score will be reset to 0.

A second ball load lever 228 is mounted adjacent the ball feed lever and moves a triangular pad 230 up and down in a generally vertical fashion. The triangular pad 230 is canted slightly so that a ball resting thereon adjacent the rib 222 will be lifted and urged over the rib into the feed channel whenever the ball load lever 228 is depressed. Once a ball is in the feed channel 88 it may be propelled onto the playing board 30 by actuation of the plunger 96 as previously described. Therefore, the above described invention provides an exciting, playable pinball machine which eliminates the need for all of the relays conventionally used in pinball machines. Furthermore, the device is much simpler in construction and manufacture than the usual commercial models. Furthermore, the simultaneous actuation of the respective elements by a single solenoid greatly reduces the number of parts and thus the overall cost of a pinball machine produced in accordance with the present invention.

The foregoing detailed description has been given for clearness of understanding only and no unnecessary limitations should be understood therefrom as some modifications will be obvious to those skilled in the art.

We claim:

1. A pinball game apparatus, comprising:

an inclined playing board having a ball exit opening formed in the lower portion thereof and a ball entrance opening formed in the upper portion thereof;

means for propelling a ball through said entrance opening so that the ball may gravitate downwardly over the playing board;

two pairs of transversely aligned actuatable flippers pivotally mounted on the playing board for contacting the ball rolling thereover to change the direction of travel of the ball;

mechanical linkage means for simultaneously actuating said pairs of flippers for pivotal movement, said linkage means including gear means between an upper pair of said flippers and crank means between a lower pair of said flippers to rotate the flippers of each pair in opposite directions;

a plurality of player operable switches electrically connected in parallel between a power supply and a first single solenoid for operating said linkage means for simultaneous actuation of all of said flippers in response to manual operation of any of said switches;

a plurality of rocking wafer-type ball bumpers mounted on the playing board for engagement by a ball rolling thereon, each bumper including a vertically movable ball projecting ring movable between a first retracted position and a second ball engaging position;

bumper drive means connected to said ball projecting ring for simultaneously moving the ball projecting rings of all of the bumpers from their first position to their second position in response to engagement of a ball with any one of said bumpers, said bumper drive means including a second single solenoid connected to all of said ball projection rings, said second solenoid being energized in response to engagement of a ball with any one of said bumpers;

a plurality of slingshot cushions, each including a resiliently flexible band mounted above the playing board by a plurality of stationary posts mounted on the playing board;

at least one actuator in proximity with each of the bands to detect the engagement of a ball with a band;

ball propulsion means adjacent each of said bands and operatively associated with the actuators for simultaneously sharply moving the same to propel a ball back over the playing board;

cushion drive means comprising a third single solenoid connected to each of said ball propulsion means for simultaneous operation of said plurality of cushions in response to engagement of any band by a ball rolling on the playing board engaging one of said bands as detected by one of said plurality of actuators; and scoring means for registering a score whenever said first, second or third solenoids are energized by engagement of a ball with any one of said solenoid energizers.

2. An improved pinball game apparatus, comprising in combination:

a frame;

an inclined playing board mounted on the frame and inclined downwardly toward a player position, a ball exit opening formed at the lower end of the playing surface and a ball entrance position at the upper end of the playing surface;

spring plunger means for propelling a ball upwardly along one edge of the playing surface through said entrance opening so that the ball may gravitate downwardly over the playing surface, ball feed means for delivering a ball to said ball propelling plunger;

two pairs of transversely aligned flippers pivotally mounted on the playing surface for contacting a ball rolling thereover, said pairs of flippers including an upper pair of adjacent flippers and a lower pair of spaced apart flippers, said upper pair being positioned for outward and upward pivotal movement and said lower pair being positioned for inward and upward pivotal movement in an attempt to hit the ball to change the direction of travel thereof;

mechanical linkage means for simultaneously actuating said pairs of flippers for pivotal movement, said linkage means including engaged gear segments between said upper pair of flippers and pivotal crank means between said lower pair of flippers to rotate the individual flippers of each pair in opposite directions;

a plurality of player operable pushbutton switches electrically connected in parallel between a power supply and a first single solenoid to operate said linkage means for simultaneous pivoting of all of said flippers in response to manual operation of any of said pushbutton switches;

a plurality of rocking wafer-type ball bumpers mounted on the playing surface for engagement by a ball rolling thereover, each bumper including a vertically movable ball projecting ring movable between a first retracted position above the playing surface and a second ball engaging position closer to the playing surface;

bumper drive means connected to said ball projecting rings for simultaneously moving the ball projecting rings of all of said bumpers from their first position to their second position in response to engagement of a ball with any one of said bumpers, said bumper drive means including a second single solenoid connected to all of said ball projecting rings, said second solenoid being energized in response to engagement of a ball with any one of said bumpers;

a plurality of slingshot cushions, each including a resiliently flexible band mounted above the playing surface by a plurality of stationary posts mounted on the playing surface;

an actuator in proximity to each of said resilient bands to detect the engagement of a ball with the respective band;

ball propulsion means adjacent each of said bands and operatively associated with the actuators for simultaneously sharply moving the band to propel a ball back over the playing surface;

cushion drive means comprising a third single solenoid connected to each of said ball propulsion means for simultaneous operation of said plurality of cushions in response to engagement of any band by a ball rolling on the playing surface engaging one of said bands as detected by one of said plurality of actuators; and a scoring system including at least one ball actuated switch on the playing surface, a counter, a signal device, and scoring drive means connected to said counter for incrementing the same in response to actuation of said switch by a ball and actuation of said first, second or third solenoids, said scoring drive means simultaneously actuating said signal device upon incrementation of said counter to provide an audible signal.

* * * * *